US006578936B1

(12) United States Patent
Darman

(10) Patent No.: US 6,578,936 B1
(45) Date of Patent: Jun. 17, 2003

(54) CONTINUOUS ROLL TOWEL DISPENSER

(76) Inventor: Pamela Darman, 124 Colonial Dr., New Hartford, NY (US) 13413

( * ) Notice: Subject to any disclaimer, the term of this patent is extended or adjusted under 35 U.S.C. 154(b) by 0 days.

(21) Appl. No.: 09/722,226

(22) Filed: Nov. 27, 2000

(51) Int. Cl.[7] ..... B65H 61/00
(52) U.S. Cl. ..... 312/34.11; 312/34.8
(58) Field of Search ..... 312/34.1, 34.4, 312/34.5, 34.6, 34.8, 34.9, 34.11, 34.24; 221/44, 45, 46

(56) References Cited

U.S. PATENT DOCUMENTS 2,144,087 A * 1/1939 Von Schlegell ..... 312/34.11
4,856,854 A * 8/1989 Nishiyama et al. ..... 312/34.11
5,820,231 A 10/1998 Schön ..... 312/34.11

FOREIGN PATENT DOCUMENTS

CA 465802 * 6/1950 ..... 312/34.11

* cited by examiner

*Primary Examiner*—James O. Hansen
(74) *Attorney, Agent, or Firm*—Robert O. Wright

(57) ABSTRACT

A continuous loop roll towel dispenser actuated by pulling on the loop of toweling with the hands is shown in which the next user can dispense a fresh segment of towel without contacting the used towel portion.

4 Claims, 5 Drawing Sheets

PRIOR ART FIGURE 1

CONTINUOUS ROLL TOWEL DISPENSER

This invention relates to roll web dispensers and more particularly to continuous roll towel dispensers in which a portion of the dispensed web is grasped by the hands of the user to actuate the dispensing of a clean unused length of web material.

BACKGROUND OF INVENTION

Continuous roll towel dispensers in which a loop of towel material is fed out of a slot adjacent the front bottom edge of the dispenser and returned into the dispenser through a rear slot have been known for many years. Generally the user of these devices would grasp the edges of the front of the loop adjacent the top of the loop as it exits the dispenser slot and pull down to dispense a clean unused portion of towel. Depending on the extent of usage of the exposed loop by the prior user a person grasping the towel edges to dispense a clean portion may contact the used portion of the towel with the undesired effect of possible contamination from the prior user.

PRIOR ART

Over the years various attempts have been made to present to a subsequent user a clean portion of towel to be grasped for the purpose of dispensing a full length of clean unused towel. These have involved sophisticated powered devices, time delay releases, retracter mechanisms and the like which sometimes malfunction. U.S. Pat. No. 5,820,231 shows a dispenser of this type in which the used towel is retracted into the dispenser housing and a blister like downward protrusion of the cabinet is used to hold the edges of a clean portion of towel away from the cabinet bottom so the next user may grasp clean towel to pull out a length sufficient to dry the hands. This is an expensive and complicated way to try and ensure the next user does not grasp used towel to dispense a clean portion. None of the prior art has successfully addressed this problem in a simple and economical fashion.

OBJECTS AND SUMMARY OF THE INVENTION

Accordingly it an object of the present invention to provide a simple effective presentation of clean unused towel to a new user for actuation of the dispenser by pulling down on the towel loop with out having to use previously used towel.

It is another object of the invention to prevent ordinary use of a portion of the clean unused towel dispensed by a user for the next user to grasp to dispense another unused length of towel.

It is yet another object of the invention to prevent contact with the used towel and surfaces touched thereby by a user triggering the dispensing of a clean unused towel segment.

It is a further object of the present invention to provide a shield adjacent the clean towel dispensing slot to inhibit hand contact with the extreme upper portion of dispensed towel.

It is a still further object of the invention to provide a shield with apertures at the edges of the dispensed towel web to allow a subsequent user to grasp clean unused towel.

These and other and further objects are achieved in an embodiment of the invention in which a tab is extended downwardly from the front edge of the clean towel dispensing slot a distance sufficient to provide a clean segment of towel for a subsequent user to grasp through apertures at the ends thereof to dispense a new length of unused towel without having to contact the used towel.

DESCRIPTION OF PREFERRED EMBODIMENT

Figure 1:
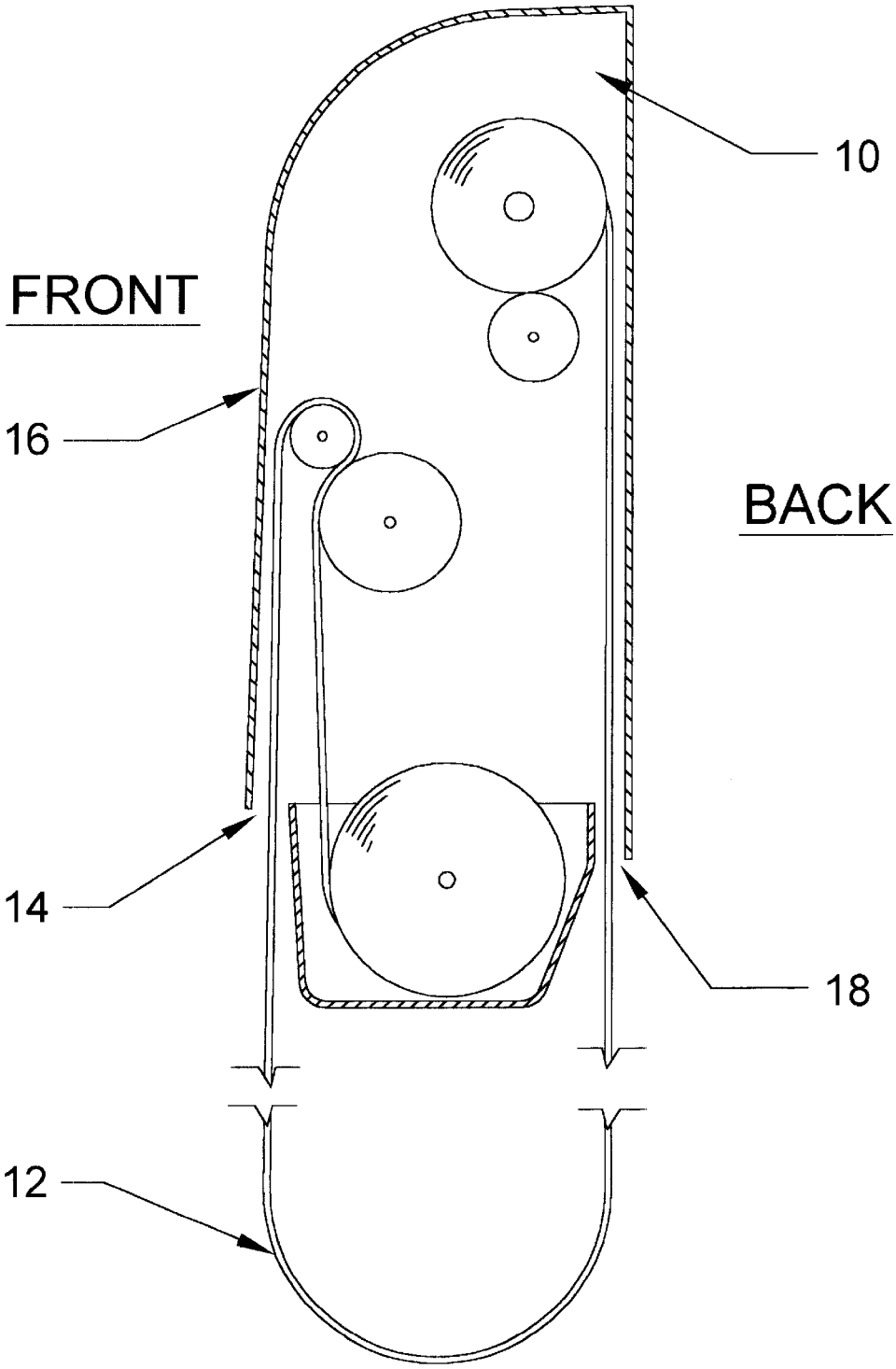
FIG. 1 is a side elevational view of a prior art device.

Referring now to FIG. 1 there is shown a typical prior art dispenser 10 in which a loop 12 of towel extends out of a slot 14 close to the front of the cabinet 16 and returns through a rear slot 18 to the takeup mechanism. The user typically will grasp the edges of the front towel loop and pull down to dispense a clean segment of towel. This clean unused segment of towel is then used to dry the hands of the user. Frequently normal usage of the dispensed segment will soil all the towel right up to the mouth of the slot 14. Thus the entire towel segment 12 will be used and dirty. The next user is thus forced to pull down a clean towel segment by grasping the dirty section first which may be very unsanitary. This has been the standard mechanical continuous roll towel device for many years.

Figure 2:
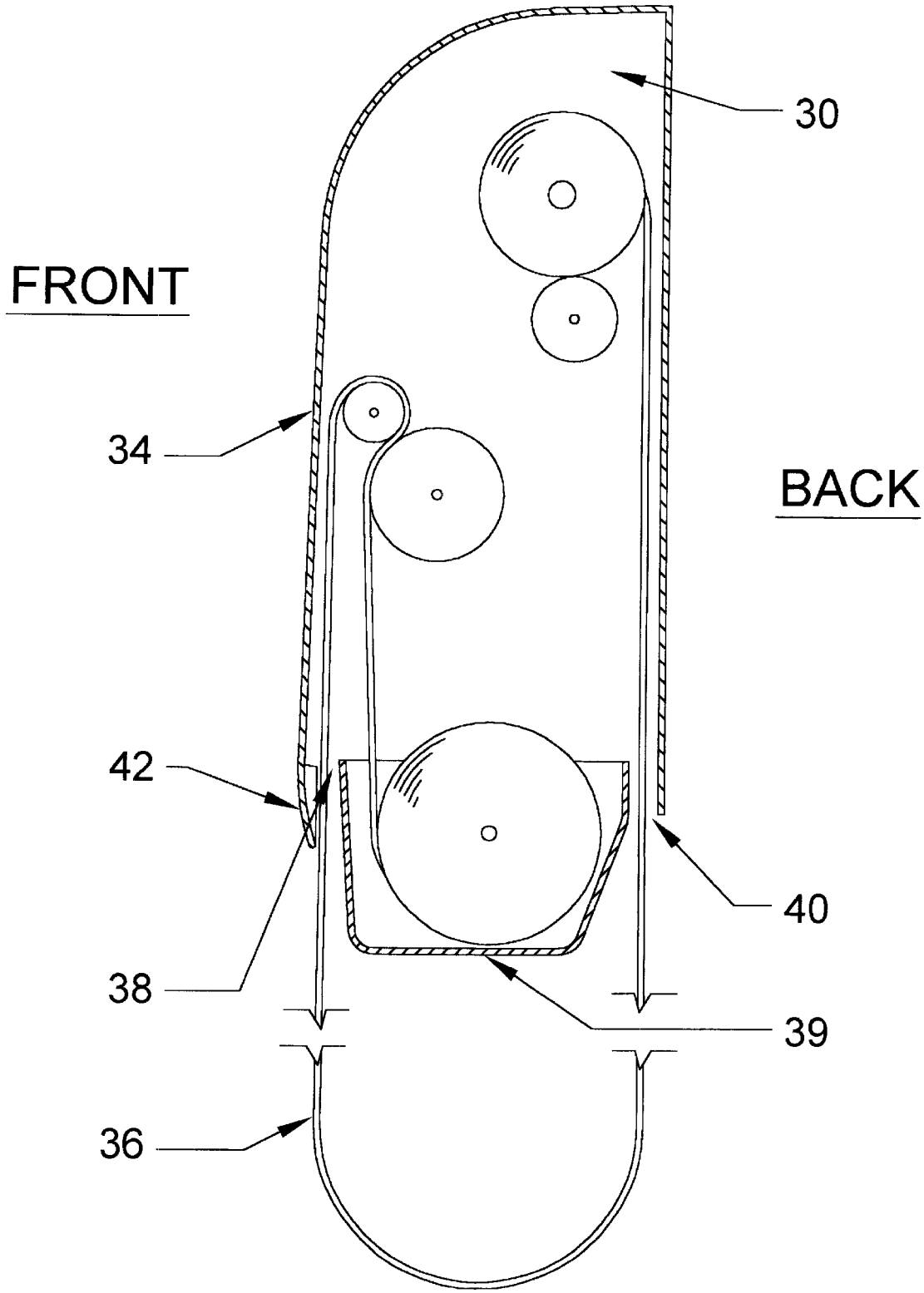
FIG. 2 is a digramatic end view, partially in section, of a web dispenser according to the present invention.
Figure 3:
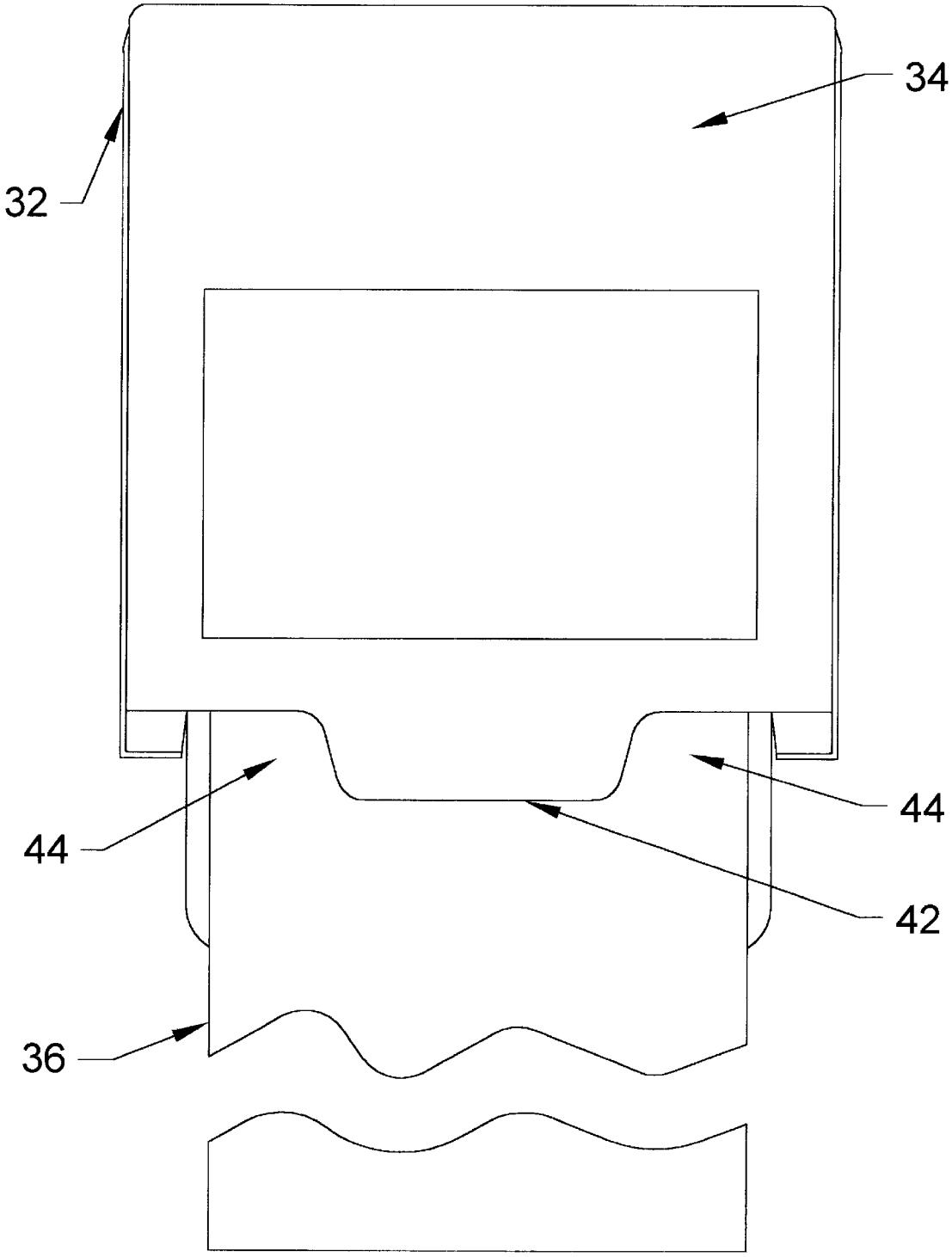
FIG. 3 is a front elevational view of the web dispenser of FIG. 2.

Turning now to FIGS. 2 and 3 there is shown a dispenser according to the present invention. Dispenser 30 has a back housing portion 32 and a front housing portion 34 forming an enclosure for a roll of clean towel and a takeup roller for the used towel in the usual manner. Towel loop 36 extends downwardly from slot 38 formed between the cabinet front 34 and the towel bin 39, and reenters the enclosure through a rear slot 40, formed between the cabinet back 32 and the bin 39. Operation of the device is similar to the prior art however dispenser 30 has a tab 42 formed as an extension of the face of front housing portion 34. Tab 42 extends across most of the width of the towel loop 36 as it emerges from slot 38 and has a vertical length of from two to four inches as desired for a particular application. The overall length of tab 42 is less than the width of the towel loop 36 forming apertures or recesses 44 at each edge of the towel web.

The user of this device will tend to dry the hands using the lower central portion of the dispensed clean unused towel loop and the tab will prevent use of the top several inches of dispensed clean towel. The next user will immediately see that the towel areas behind apertures 44 have not been used and present clean towel to be grasped between the fingers of the right and left hands respectively to dispense a clean towel segment. Suitable visual arrows and directions may be applied to the outer surface of the tab 42 if desired.

As may be seen in FIG. 2 the bin 39 is spaced away from tab 42 to provide adequate clearance for a users' hands to grasp the towel loop 36 without contact with the dirty towel or the cabinet itself which may have been contaminated from contact with a dirty towel segment or a users wet hands.

Figure 4:
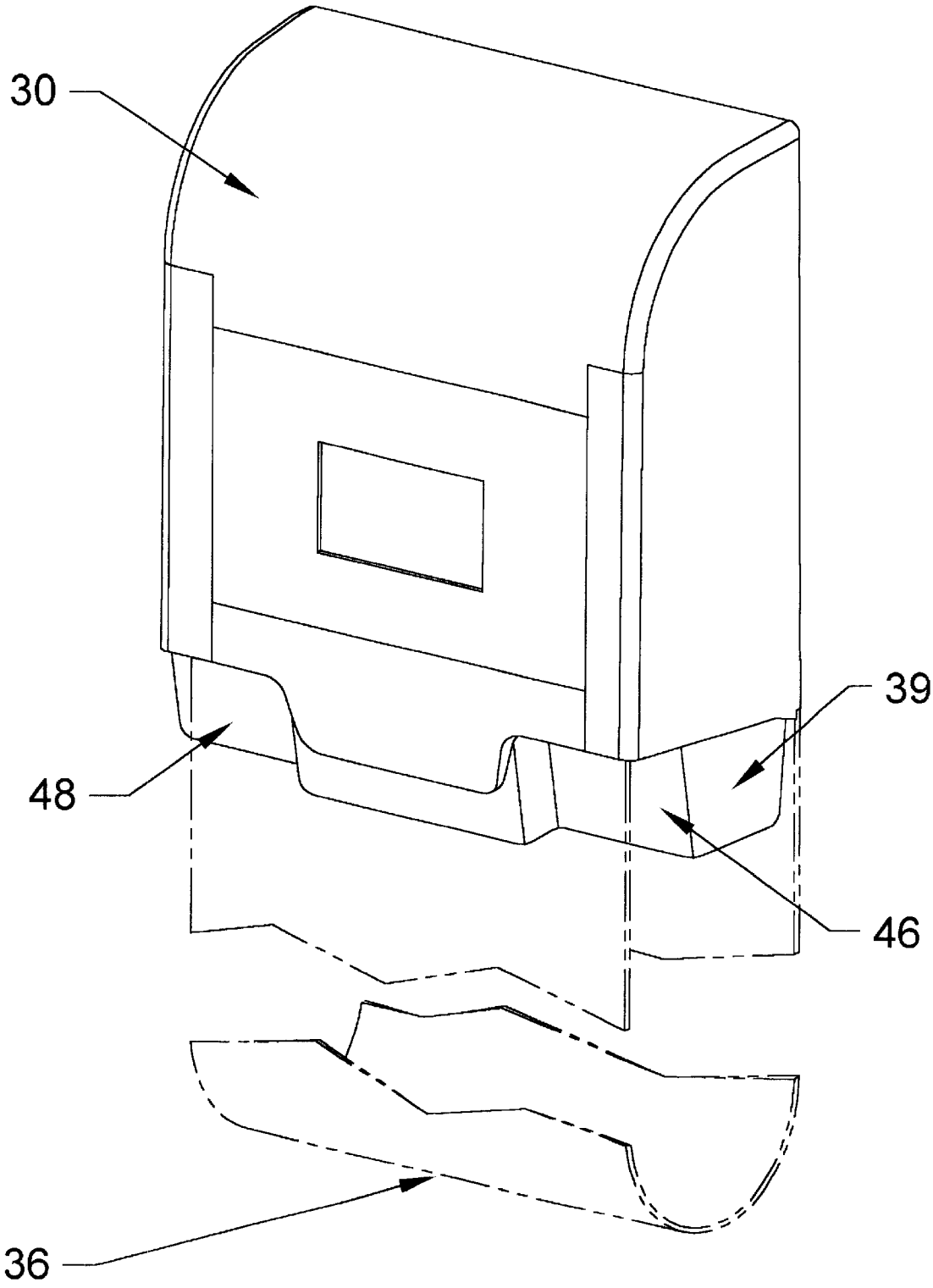
FIG. 4 is a perspective view of another embodiment of the dispenser.
Figure 5:
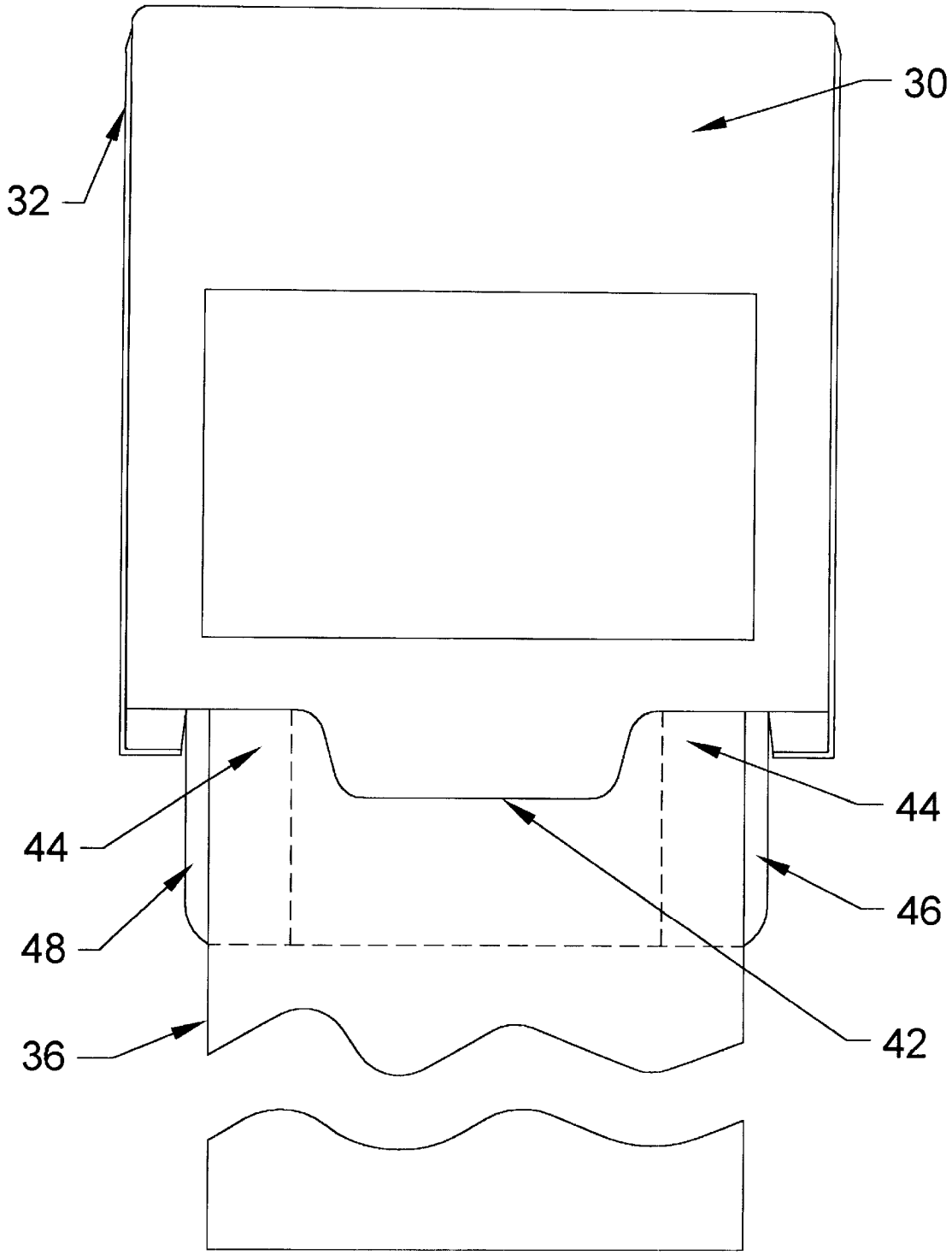
FIG. 5 is a front elevational view of the dispenser of FIG. 4.

Referring now to FIGS. 4 & 5 there is shown another embodiment of the present invention in which I have further enhanced the likelihood of the next user grasping the clean upper edges of towel loop 36 (shown in phantom in FIG. 4) behind appertures 44 to dispense an unused towel segment. Here the outer ends 46 and 48 of the bin 39 have been recessed away from the towel loop 36 toward the back housing portion 32. The visual effect is to direct the users' attention to the edges of the towel web at the upper edges exposed by recesses 44. The recesses 46 & 48 ensure that clean towel edges may be easily grasped to dispense the next clean towel segment without contacting either the dirty towel or the bin 39 of the cabinet. This ensures further separation of the subsequent users hands from the bin portion eliminating possible contamination from that source.

While there are given above certain specific examples of this invention and its application in practical use, it should be understood that they are not intended to be exhaustive or to be limiting of the invention.

I claim:

1. In a roll towel dispenser mechanism having a loop of roll towel material extending downwardly from a front dispensing slot to a rear return slot and in which a subsequent user obtains unused roll towel material by pulling downwardly on roll towel material to dispense fresh unused towel material, a continuous roll towel dispenser cabinet comprising:

a back housing portion adaptable for mounting of said dispenser cabinet on a mounting surface;

a front housing portion adapted to be connected to said back housing portion to form a compartment for containing at least a roll of clean unused towel material and a take up roll for used towel material;

said front housing portion further defining with said back housing portion a clean roll towel dispensing slot at the front bottom edge of said front housing portion and a used towel return slot at the back bottom edge of said back housing portion;

said front housing portion having a tab member extending downwardly from the front edge of said clean roll towel dispensing slot;

said tab member having a width less than the width of said clean roll towel dispensing slot in said roll towel dispenser cabinet; and said tab member having a length extending downwardly from said clean towel dispensing slot a distance sufficient to block normal hand drying usage of a central upper portion of a dispensed segment of clean unused towel material and simultaneously forming clean upper aperture portions on either side of said tab member for permitting grasping, by a subsequent user, of clean towel material to dispense another clean unused segment of towel material.

2. A roll towel dispenser mechanism as claimed in claim 1 wherein said tab member has a length of at least two inches.

3. A roll towel dispenser mechanism as claimed in claim 1 wherein said tab member is centered on the front housing portion width forming web exposing apertures at each end thereof.

4. A roll towel dispenser mechanism as claimed in claim 1 wherein said cabinet includes a bin member disposed across the bottom thereof and extending from said back housing portion to said front housing portion; and said bin member has formed therein at each front corner a recess corresponding to said tab member web exposing apertures.

* * * * *